US005779036A

United States Patent [19]

Westbrook et al.

[11] Patent Number: 5,779,036

[45] Date of Patent: Jul. 14, 1998

[54] FOOTWEAR HOLDING APPARATUS

[75] Inventors: Robert S. Westbrook, 1510 E. Third St., Benicia, Calif. 94510; Christine M. Cassidy, San Anselmo; James Dudley, Sacramento, both of Calif.

[73] Assignee: Robert S. Westbrook, San Francisco, Calif.

[21] Appl. No.: 609,522

[22] Filed: Mar. 1, 1996

[51] Int. Cl.[6] ..... A45C 3/12; A45C 13/30

[52] U.S. Cl. ..... 206/292; 206/315.1; 190/102; 224/653

[58] Field of Search ..... 206/278, 279, 206/289, 292, 315.1; 190/111, 112, 102; 280/814; 224/600, 653

[56] References Cited

U.S. PATENT DOCUMENTS

| | | | |
|---|---|---|---|
| 2,638,192 | 5/1953 | Tuller | 190/111 X |
| 2,738,976 | 3/1956 | Vallieres | 206/315.1 X |
| 4,182,391 | 1/1980 | Kjose | 206/315.1 X |
| 4,506,769 | 3/1985 | Franco et al. | 190/112 X |
| 4,958,729 | 9/1990 | Wright | 206/315.1 |
| 5,456,353 | 10/1995 | Challoner et al. | 206/292 |

*Primary Examiner*—Sue A. Weaver
*Attorney, Agent, or Firm*—Jonathan O. Scott

[57] ABSTRACT

An apparatus for securing an item of footwear may stand alone or be integral with an item of luggage. The apparatus has a continuous large flap and two flap ends with a center portion located between the two flaps. The center portion is secured to the luggage, and two flap ends are arranged to partially encircle the body section of the footwear when the footwear is placed upon the center portion. One flap end partially overlaps the other. The flaps are attached to one another such that the flap ends secure the footwear to the luggage substantially at the body section of the footwear. A rear strap is secured to either of the base portion, the center portion or a flap end and encircles the heel, section of the footwear when the footwear is placed upon the base portion. The rear strap secures the footwear to the luggage and prevents the footwear from sliding in a direction toward the heel section of the footwear. Also, a third strap encircles the body section of the footwear and prevents the footwear from sliding in a direction toward the toe section of the footwear. The large flap is shaped to conform to the item of footwear being secured in order to provide a snug fit.

14 Claims, 5 Drawing Sheets

FOOTWEAR HOLDING APPARATUS

FIELD OF THE INVENTION

The present invention relates generally to holding devices. More specifically, the present invention relates to a holding device mounted on an item of luggage for securing footwear such as skates.

BACKGROUND OF THE INVENTION

As the general public becomes more active in sports both outdoors and indoors, a wide variety of footwear has evolved to meet the demands of these sports. A variety of specialized footwear is now available for most any athletic sport. By way of example, footwear for the following sports is available: roller skates, in-line skates and ice skates; hiking boots, skiing boots and snowboarding boots; mountain biking boots and cycling shoes; rock climbing shoes and ice climbing boots. Many other kinds of footwear are also available.

As the public becomes more active, the logistics of traveling to and from a sporting location, assembling the gear required, and donning and removing the gear becomes gradually more complex. For an individual who wishes to take part in more than one sport for a day or for a vacation, it may become necessary to pack and transport different kinds of footwear for his or her activities. For example, a skier who travels to the mountains to spend a day downhill skiing and a day cross-country skiing usually brings along a pair of downhill ski boots, a pair of cross-country ski boots, a pair of insulated general purpose boots and a pair of regular shoes. It becomes difficult to carry and keep track of all the footwear. In addition, for an individual traveling by public transportation, it is necessary to pack his or her footwear inside a backpack, suitcase or other item of luggage that can contain the footwear yet also be easily carried.

In the prior art, certain types of luggage that can carry an item of footwear on the inside have been used. For example, large, bulky bags are used to carry downhill skiing boots. Indeed, most larger boots or skates can simply be placed inside a large item of luggage. One problem with this solution is that the boots or skates are loose inside the bag and can slide around. Also, it may be difficult and time consuming to open a large bag and dig around for the boots on the inside. Also, it may not be desirable to place wet or dirty boots or skates inside a bag with other clothing. In addition, the boots or skates are not visible from the outside, thus from a manufacturer's or user's point of view, the boots or skates may not be advertised or shown to the outside world.

Furthermore, an active individual may only have a small bag and may not be able to place the boots or skates on the inside. For example, a cross-country skier on a touring trip has a limited amount of space inside of a backpack. It is known in the art to form simple loops on the outside of such a backpack to hold a pair of cross-country skis while the skier is hiking, for example. However, a convenient means to secure boots to the backpack would be desirable.

Moreover, an individual who is traveling with only a backpack or luggage may wish to quickly and easily change from one item of footwear to another. For example, a mountain biker (or a cross-country skier) may wish to remove their specialized boots and don simple walking shoes for a period of time. If the individual is traveling, he or she must carry their boots in their hands, hanging from their neck, or perhaps inside of a backpack as described above. It would be desirable to have a useful apparatus for carrying such a boot on a backpack or piece of luggage in an easily accessible and secure location.

Many types of individuals who use specialized footwear and wish to carry it could benefit from such an apparatus. By way of example, one such user is a person who uses roller skates or in-line skates (sometimes called ROLLER BLADES®). For an illustrative example, the following scenarios describe how individuals who are active in in-line skating could benefit from such a holding apparatus.

In-line skating is an indoor and outdoor pastime that has evolved from traditional roller skating equipment and techniques. This new generation of skate utilizes high-density polyurethane wheels mounted "in-line" on a plastic boot resembling a ski boot. Skaters may travel on concrete or asphalt as would normally be done with the predecessor equipment. Skaters may also skate in an indoor rink.

One problem with in-line skating outside of a rink is that it may be necessary to change footwear. For example, skaters are limited in their activities and may have to make accommodations for environments where skates are not allowed and conventional footwear must be worn. For example, skaters going to a local shopping mall or to school are forced to carry shoes with them to put on once they have reached the mall or school and must carry the skates on their person during the time spent there. Skaters who travel anywhere downtown are usually obligated to remove their skates when entering any restaurant, store or even using sidewalks. Indeed, it is common to see signs stating "No Skates Allowed." When not used, these shoes or skates must be carried by hand or by other prior art methods discussed above. As the skater has arrived by skate, there is no automobile or other in which to store the skates. This is an awkward situation for the skater.

An existing backpack that attempts to address this problem is the "In-line Skating Pack" by Kipling of Middlesex, N.J. as shown in FIGS. 1 and 2. This version is difficult to use due to the awkward configuration of the attachments and has other deficiencies as will be described below.

FIG. 1 shows a prior art Kipling pack 10. The pack consists in general of a main pocket 12, a front flap 14, a front panel 16 that attaches to the main pocket by a zipper 20. The pack also has a carrying loop 18. A strap 22 is used to hold skates. The strap 22 is attached to the front panel 16 by stitching 24 and has two ends 26 and 28 that can be inserted into corresponding buckles 30 and 32. Skates may be placed into the loops formed by strap 22. However, it is not immediately obvious how to insert the skate into the loop. And of the various ways to insert the skate into the loop, none produces a secure attachment. For example, if the skates are inserted toe first, in a downward direction through the loops, the top part of the pack becomes very top heavy and unwieldy. In this orientation, if the wheels of the skates both face inward it is difficult to fit the skates as the wheels collide. And if the wheels face outward, the ankle portions of the skates hit one another, preventing insertion. And if the ankle portions of the skates are inserted upward through the loops, the toe portions stick out too far to the sides.

The pack 10 also has a front flap 14 which can be folded up to attempt to secure the skates. This front flap 14 has a cut out region 40 and two buckles 42 and 44. These buckles will attach to the buckles 46 and 48 which connect to the main body of the pack via short straps 50 and 52. FIG. 2 shows this front flap 14 in its up position. Buckles 42 and 44 have been attached to buckles 46 and 48. Front flap 14 is able to cover the skates, but as it does not encircle nor constrict the skates, it does a poor job of securing the skates tightly. And because strap 22 is only a single thin strap around each skate, it also does a poor job of firmly securing the skates to the backpack. The net result is that the skates are not securely attached to the backpack. Also a total of four buckles must each be unbuckled and readjusted each time the skates are inserted or removed.

Therefore, it would be desirable to have a holding apparatus for use with skates or other types of footwear that would be mounted on a backpack or other item of luggage. It would further be desirable for such an apparatus to be easily accessible, easy to attach the footwear, able to hold the footwear securely and at the same time display the footwear.

SUMMARY OF THE INVENTION

An embodiment of the present invention is arranged to secure an item of footwear or the like. The invention has a center portion with a first end and a second end. A first flap is secured to the center portion first end and is arranged to partially encircle the body section of the footwear when the footwear is placed upon the center portion. A second flap is secured to the center portion second end and is also arranged to partially encircle the body section of the footwear when the footwear is placed upon the center portion. A flap attaching means for is used for attaching the first flap to the second flap to produce an encirclement. In this fashion the first and second flaps secure the footwear within the encirclement substantially at the body section of the footwear. A first rear strap may be secured to either the center portion or the first flap and is also arranged to partially encircle the body section of the footwear when the footwear is placed upon the center portion. A second rear strap is secured to the center portion and is arranged to partially encircle the heel section of the footwear when the footwear is placed upon the center portion. Also, a rear strap attaching means is used for attaching the first rear strap to the second rear strap such that the first and second rear straps secure the footwear to the center portion and prevent the footwear from sliding in a direction toward the heel section of the footwear.

In another embodiment, the invention is integral with an item of luggage such as a backpack which serves as the base portion. The invention includes a continuous large flap that has a first flap end, a second flap end and a center portion located between the first flap end and the second flap end. The center portion is secured to the base portion, and the first flap end and the second flap end are arranged to partially encircle the body section of the footwear when the footwear is placed upon the center portion. The first flap end may also partially overlap the second flap end. A flap attaching means is used for attaching the first flap end to the second flap end such that the first and second flap ends secure the footwear to the base portion substantially at the body section of the footwear. A first rear strap is secured to either of the base portion or the first flap end and partially encircles the body section of the footwear when the footwear is placed upon the base portion. A second rear strap is secured to the base portion and is arranged to partially encircle the heel section of the footwear when the footwear is placed upon the base portion. A rear strap attaching means attaches the first rear strap to the second rear strap such that the first and second rear straps secure the footwear to the base portion and prevent the footwear from sliding in a direction toward the heel section of the footwear. Also, a third strap encircles the body section of the footwear and prevents the footwear from sliding in a direction toward the toe section of the footwear.

BRIEF DESCRIPTION OF THE DRAWINGS

The invention, together with further advantages thereof, may best be understood by reference to the following description taken in conjunction with the accompanying drawings in which.

DETAILED DESCRIPTION OF THE INVENTION

In one embodiment of the invention, the holder may be arranged to accommodate a roller or in-line skate. Skaters may carry their shoes and/or skates on the exterior of the backpack by using the holding apparatus. Once they have reached their destination, the skater may change to conventional footwear by removing the skates from their feet and placing them in the holding apparatus. This allows for freedom from carrying the skates manually, the use of only one backpack for any size of skate, fast and efficient attachment to and removal from the backpack, and for display of the skates. This display provides basic ego gratification and potential marketing benefits a manufacturer might realize by having brand-name skates displayed on the outside of a backpack. These and other advantages will become apparent from the description below.

Figure 1:
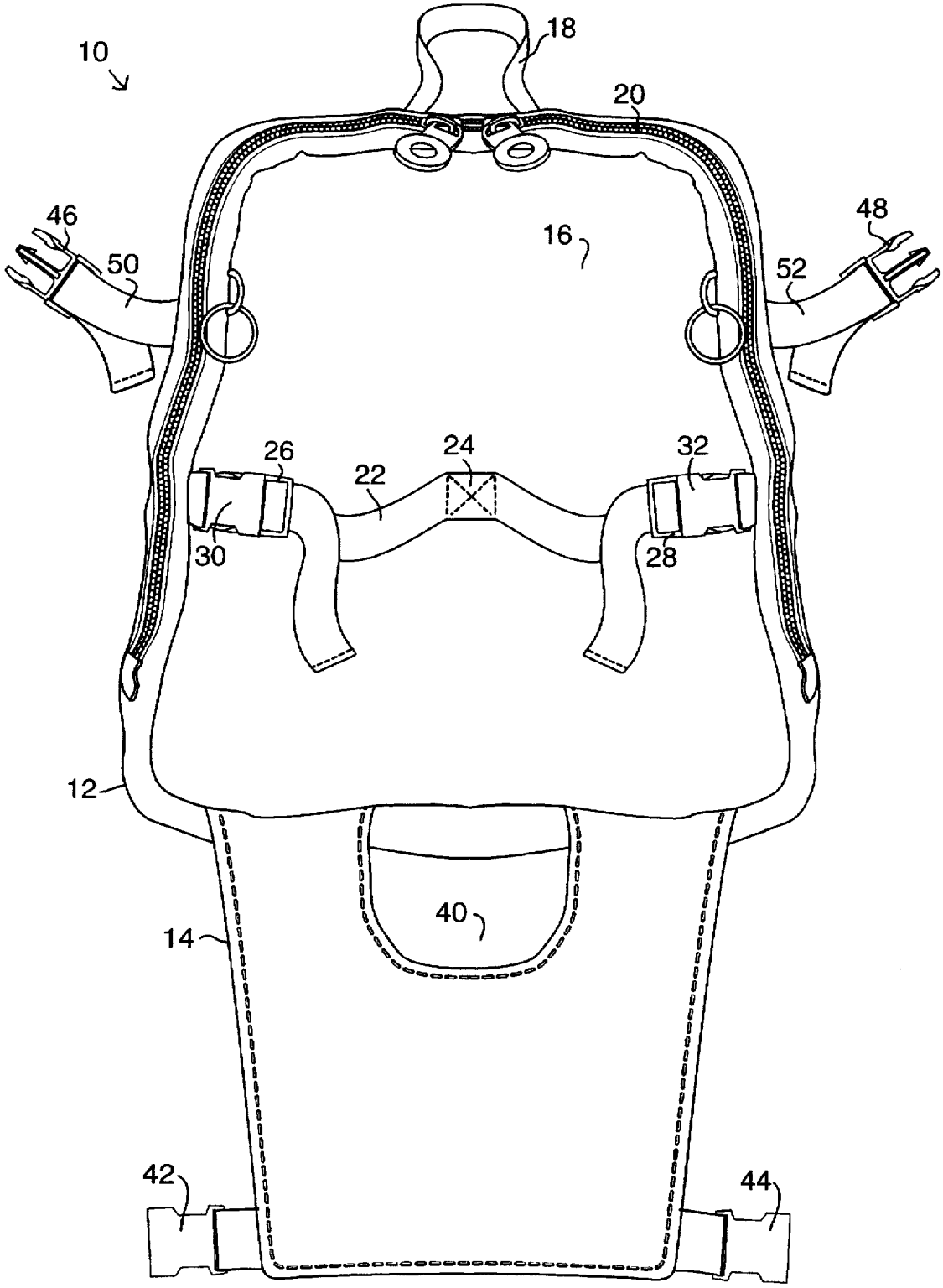
Fig. 1 (Prior Art)
FIG. 1 is a prior art backpack shown with its flap hanging down.
Figure 2:
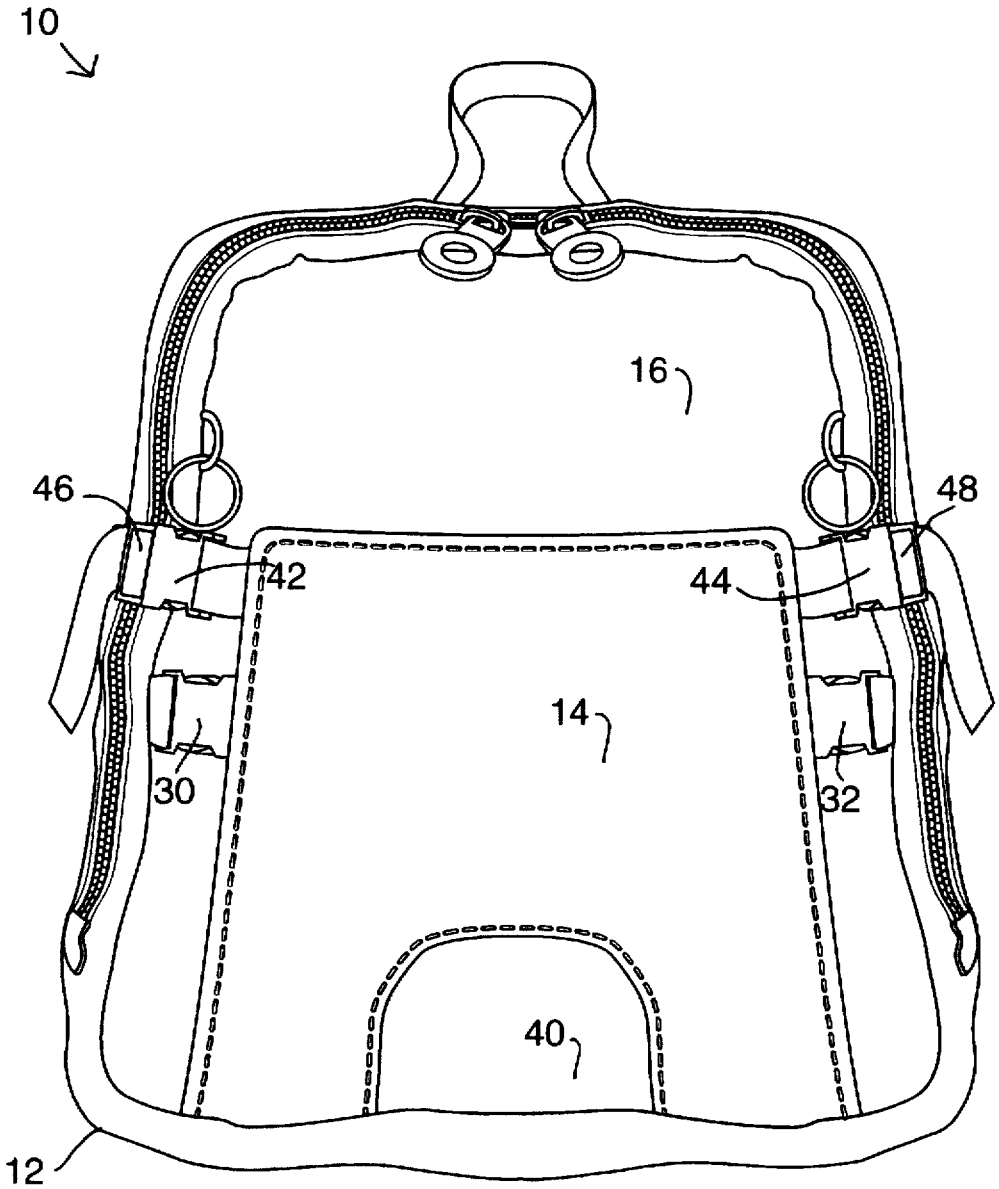
Fig. 2 (Prior Art)
FIG. 2 is a prior art backpack shown with its flap in the up position.
Figure 3:
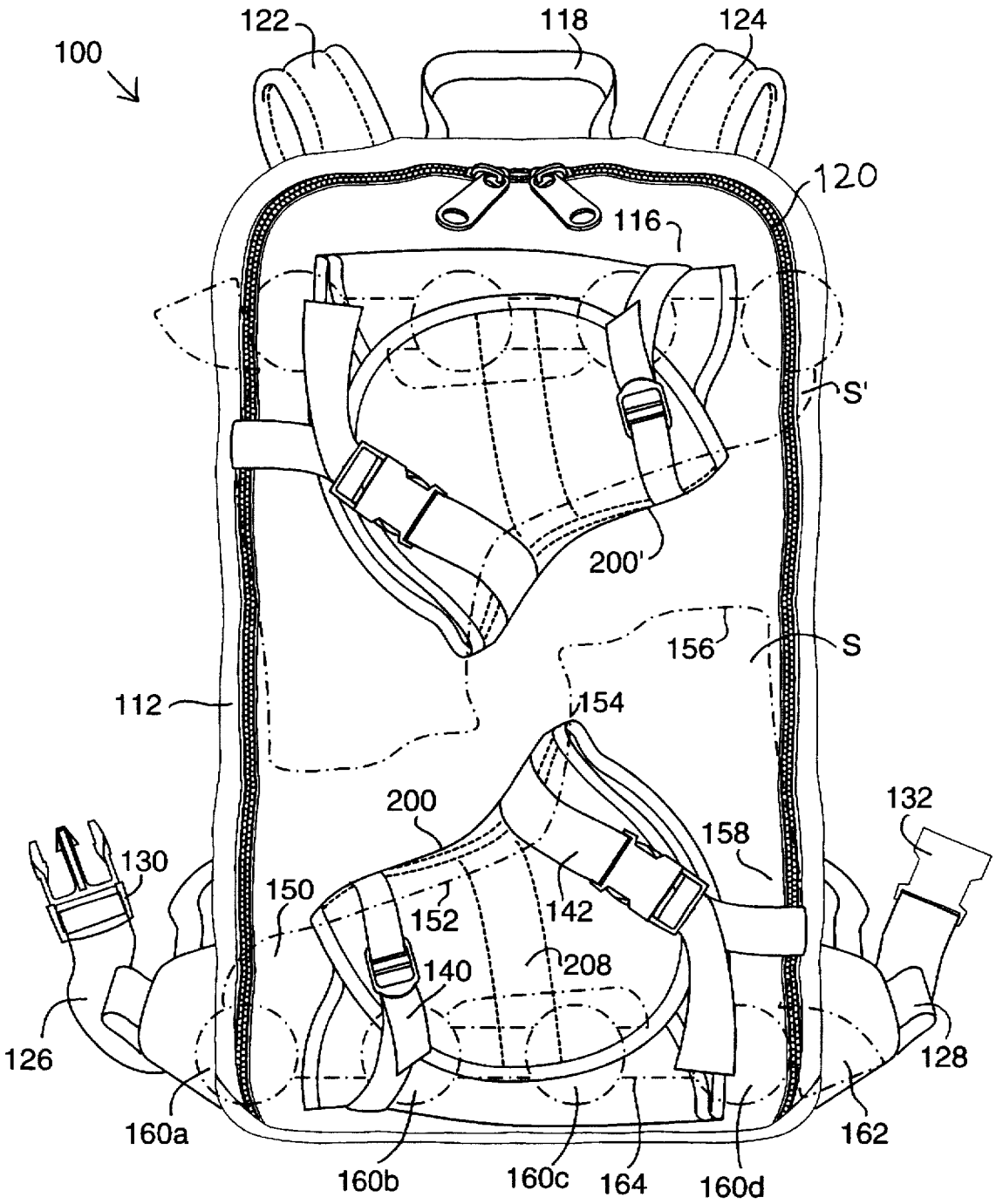
FIG. 3 is an embodiment of the present invention in which two holders are shown mounted on a backpack.

FIG. 3 shows at 100 a backpack and holders according to one embodiment of the invention. The backpack has holders 200 and 200' which will be described in more detail below with reference to FIGS. 4 and 5. The holders 200 and 200' each may secure an item of footwear such as the in-line skates S and S' as shown. As mentioned above, a wide variety of footwear may be secured in the holders. For illustrative purposes, two in-line skates are shown. It is also contemplated that any object with the general shape of an item of footwear may be secured in the holders. Also, it is contemplated that a backpack 100 may have only one holder 200, or it may have many such holders mounted upon it. Furthermore, although the holders are shown mounted on the outside of the backpack, it is conceivable that the holders could be mounted on the interior of a backpack, an item of luggage or the like.

Backpack 100 includes a main pocket 112, a front panel 116, a carrying strap 118 and a zipper 120 that attaches the front panel to the main pocket, thus forming the interior of the backpack. In this example, holders 200 and 200' are attached to the outside of the front panel 116. Holder 200 secures skate S via a front strap 140 and a rear strap 142. Skate S has a toe portion 150, a body portion 152, an ankle portion 154, a foot opening 156 and a heel portion 158. Skate S also has wheels 160*a*, 160*b*, 160*c*, 160*d* and a brake 162. For those skates for which the boot is detachable from the skate itself, portions 150, 152, 154, 156 and 158 refer to that region of the skate where the boot is placed during operation. For example, portion 156 would refer to an ankle cuff, stiff ring, or the like.

Front strap 140 may encircle skate S substantially at the toe or body portions. Rear strap 142 may encircle skate S substantially at the body and ankle portions, and also passes behind the heel portion in order to prevent skate S from coming out backwards. Skate S is prevented from moving forward due to the pressure from front strap 140, and also due to the narrowing of the holder 200 in relation to the shape of skate S within it.

Backpack 100 also includes shoulder straps 122 and 124, and a hip belt that is formed by belts 126 and 128 that attach to one another around a wearer's waist by way of buckles 130 and 132. It should be apparent that holder 200' can be formed in the same fashion as holder 200, except that holder 200' may be mounted upside-down in relation to holder 200. In addition, holder 200' may also be mounted next to holder 200, or may be mounted right-side up in relation to holder 200. Any orientation between the two holders is possible, although it is preferable to mount them as shown in FIG. 3 in order to conserve space Referring now to FIG. 4, the holder 200 from FIG. 3 will now be described in detail. Shown is the holder 200 in its closed position, although two of the straps are unattached. Holder 200 has a top flap 202, a bottom flap 204 and a center portion 206. When closed, the holder forms an opening 226 through which a skate or the like may be inserted in order to protrude through the other opening formed 224. A wide variety of materials may be used to form the holder. By way of example, materials such as nylon or canvas may be used, with a BALLISTICS brand heavy cloth working well. The center portion may be omitted if the top and bottom flaps are attached directly to the fabric of a backpack, for example.

In this embodiment, the bottom flap and center portion are all formed from one continuous piece of material and the top flap 202 is sewn to the center portion at 203. It is contemplated that these may all be separate pieces that are attached in some fashion, for example, by sewing. The top flap 202 may be secured to the bottom flap 204 by a wide variety of techniques including 25 snaps, zippers, glue, buckles or the like. By way of example, a strip of VELCRO 208 may be used to secure the top flap 202 to the bottom flap 204. It is contemplated that strip 208 may not be needed, although it is preferable to have it in place. Top flap 202 may overlap bottom flap 204 and thus in this fashion the holder is adjustable via the VELCRO strip 208 to fit a wide variety of sizes of skates or other footwear. In other words, the holder functions as a "one size fits all."

The front strap 140 and the rear strap 142 as shown in FIG. 3 will now be described in detail. Preferably, the front strap is formed from a continuous piece of material having a lower end 210 and an upper end 212. This continuous front strap may be attached to the top flap, center portion and bottom flap by different techniques. Preferably, this front strap is sewn to these portions of the holder. A wide variety of methods may be used to attach the two ends and cinch the strap tight around the skate. By way of example, a simple threaded buckle 214 may be used. End 210 may be threaded through buckle 214 and in this fashion cinch down upon the skate tightly. A LADDERLOCK brand buckle works well.

The rear strap is preferably in two pieces. An end 218 may be sewn to both the center portion and the top flap. The end 216 is sewn to the center portion. It is also possible that the rear strap is formed from a continues piece of material as is the front strap. The rear strap is connected by joining ends 218 and 216 via a female connector 222 and a male connector 220. Although a wide variety of connectors are available, it is preferable to use a FASTEX brand buckle as shown.

Figure 4:
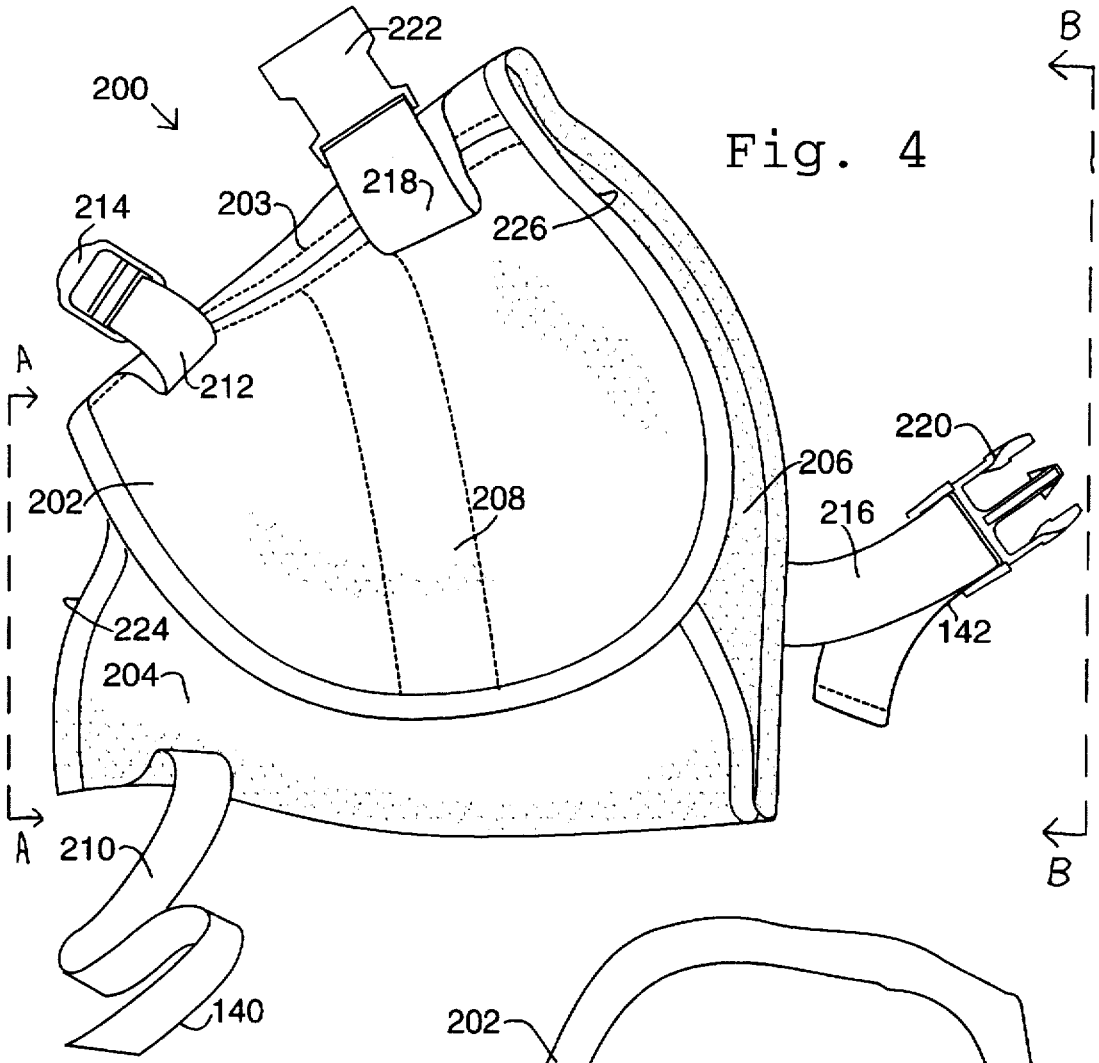
FIG. 4 is a front view of a holder shown closed according to one embodiment of the invention.
Figure 4A:
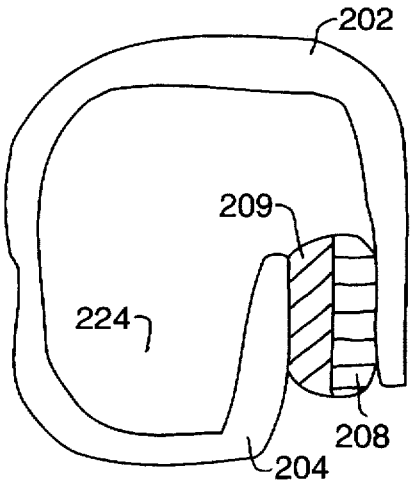
FIG. 4A is a side view of the holder of FIG. 4 taken along line A—A.
Figure 4B:
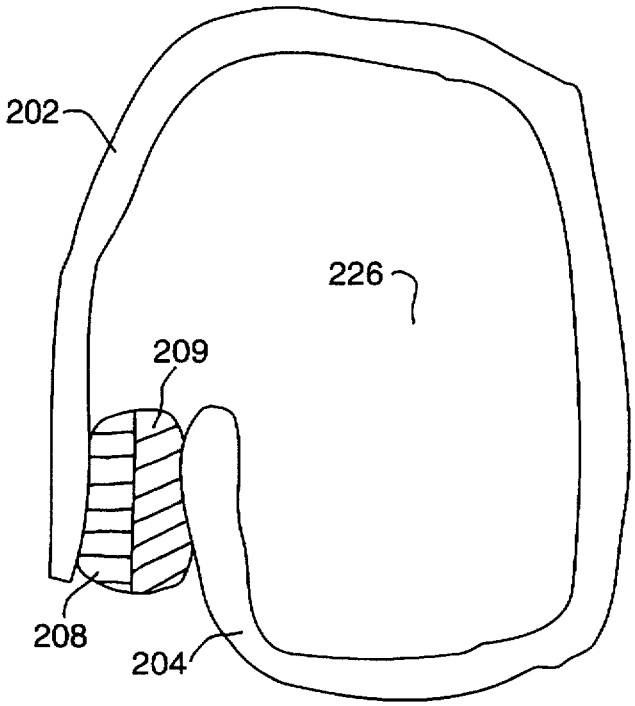
FIG. 4B is a side view of the holder of FIG. 4 taken along line B—B.
Figure 5:
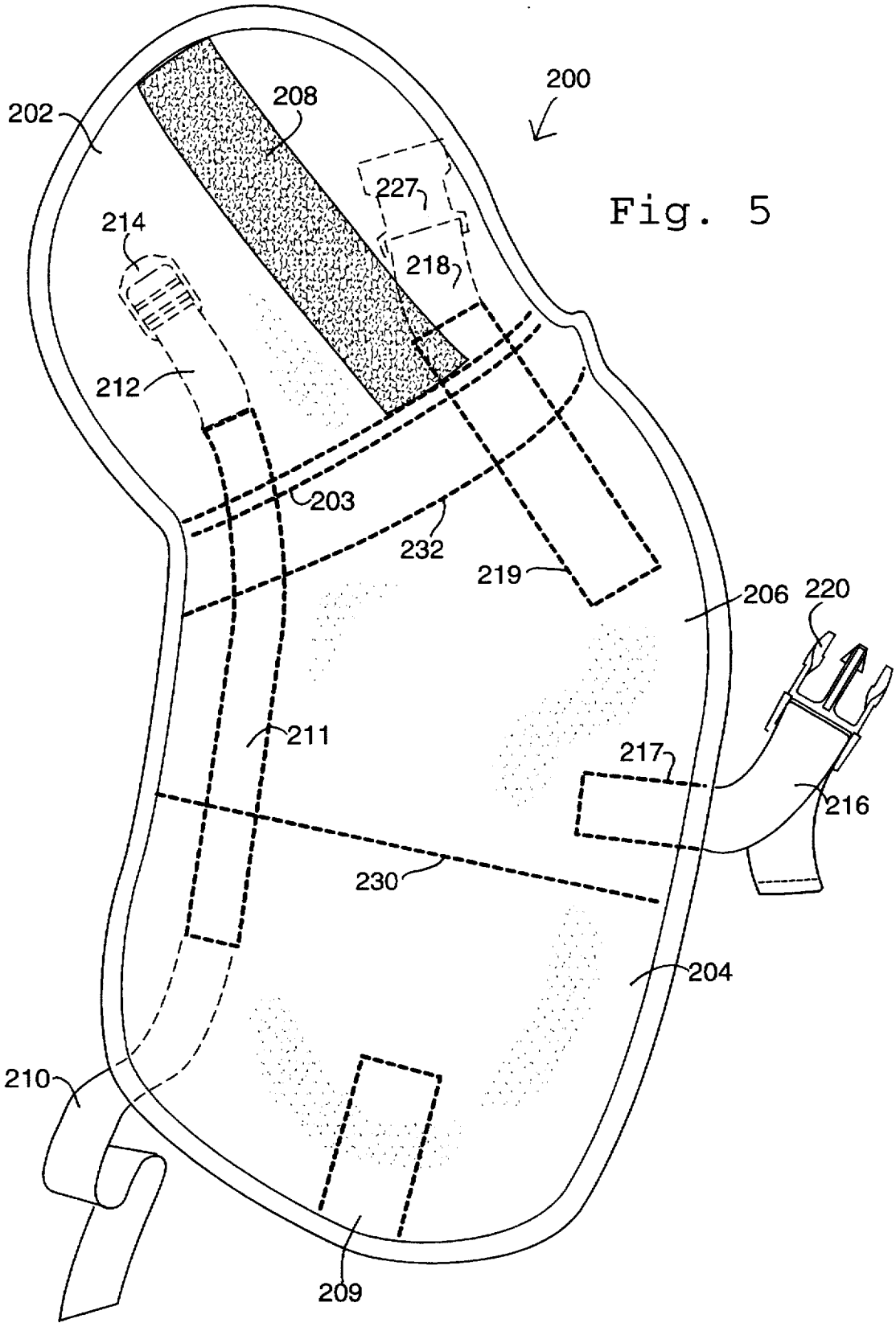
FIG. 5 is a front view of a holder shown in a fully open position according to one embodiment of the invention.

Turning now to FIG. 5, the holder 200 from FIG. 4 will now be described in detail in its open position. Shown at 200 is a holder which has been opened and lain flat. The holder has a top flap 202, a bottom flap 204 and a center portion 206. The top flap has a VELCRO strip 208 and the bottom flap has the counterpart VELCRO strip 209. An end 210 of the front strap is shown with its opposite end 212 attached to buckle 214. This front strap is attached to the holder by stitching 211. An end 216 of the rear strap is attached to the center portion via stitching 217 and has a male connector 220. Likewise, the other end 218 of the rear strap is attached via stitching 219 and has a female connector 222. As the holder is open, buckles 214 and 222 are shown in outline because they are underneath top flap 202.

Holder 200 may be attached to a backpack by different methods. Stitching, VELCRO, snaps, zippers and the like may be used to attach a holder to a backpack, item of luggage or the like. It is preferable to attach holder 200 by stitching as shown by stitching lines 230 and 232. In order to conform best to the shape of an item, it is preferable that stitching lines 230 and 232 mirror the profile of the item. By way of example, stitching line 230 is straight to correspond to the straight contour of the bottom of an in-line skate. Likewise, stitching line 232 has a slightly curved contour to correspond to the curved shape of the upper portion of an in-line skate. It is contemplated that these stitching lines 230 and 232 may be modified in order to conform better to the shape of the item that is being inserted in the holder. For example, for a high-top ice-climbing boot or the like that has a pronounced rake forward in the ankle section, stitching line 232 may have a more sharply curved contour in order to conform to this boot. Additionally, stitching line 230 may be shaped to accommodate the bottom surface of an item of footwear, such as the wheels of an in-line skate. Furthermore, for those in-line skates in which the boot is detachable from the skate itself, stitching line 230 may have a more straight contour in order to conform to the flat base of the skate from which the boot has been removed.

Stitching may also be used within or around the region formed by stitching lines 230 and 232.

A technique for inserting and carrying a skate or the like will now be described. Referring to FIG. 4, once top flap 202 has been secured to bottom flap 204 via VELCRO 208, a skate may be inserted from the right-hand side. Alternatively, the skate may be placed on the holder while open and then it may be closed. Front strap 140 is then tightened around the front of the skate. Next, rear strap 142 is attached around the heel portion of the skate by connectors 220 and 222. As end portion 216 is adjustable, this rear strap can be tightened in order to provide a very snug and secure fit for the skate. In this position, the skate is immobile, even if the backpack is jostled or swung around.

Removal of the skate simply requires unsnapping connectors 220 and 222. The skate can now be easily removed from the opening 226. Note that removal only requires undoing one buckle, unlike two or more in the prior art. Also, the rear strap need not be loosened for removal, merely undoing the buckle is sufficient. And now insertion of the skate is extremely simple. As VELCRO 208 and front strap 140 have already been cinched down to conform to the skate, they need not be adjusted again for future insertion or removal. For insertion, the skate is simply inserted into opening 226 until the toe protrudes through opening 224. The skate will be snug as VELCRO attachment 208 and front strap 140 have already been sized correctly. All that is now required is simply inserting connector 220 into connector 222 and the skate is now secure. Note that insertion only requires fastening one buckle, unlike two or more in the prior art.

Although the foregoing invention has been described in some detail for purposes of clarity of understanding, it will be apparent that certain changes and modifications may be practiced within the scope of the appended claims. For instance, any item of footwear or any object that has the same general shape as footwear may be secured within the holder. For example, those in-line skates in which the boot is detachable from the skate itself may also secured by the invention. For example, in-line skates such as the SOFT-BOOT™ made by K2® may be secured to the invention even though the boot itself has been removed from the skate. Also, a holder may attach to a backpack, a large carry bag, a gym bag, a suitcase or other item of luggage, and may attach either to the exterior or to the interior. The buckles, connectors and straps shown may be of any suitable type. Therefore, the described embodiments should be taken as illustrative and not restrictive, and the invention should not be limited to the details given herein but should be defined by the following claims and their full scope of equivalents.

We claim:

1. A footwear holding apparatus for securing an item of footwear, the item of footwear having an opening for a foot to be inserted, a toe section, a body section located forward of the opening between the toe section and the opening, and a heel section located rearward of the opening, the footwear holding apparatus comprising:

a base portion to which the footwear can be secured;

a first flap secured to the base portion and arranged to partially encircle the body section of the footwear when the footwear is placed upon the base portion;

a second flap secured to the base portion and arranged to partially encircle the body section of the footwear when the footwear is placed upon the base portion, wherein the first and second flaps form a continuous large flap with a center portion, the center portion being secured to the base portion, and the large flap is arranged to completely encircle the footwear when the first flap is attached to second flap and to cover a substantial portion of the body section of the footwear;

a flap attaching means for attaching the first flap to the second flap such that the first and second flaps secure the footwear to the base portion substantially at the body section of the footwear, said first flap shaped such that a curved contour of said first flap matches with a curved contour of a top surface of the item of footwear thus providing a snug fit;

a first rear strap secured to one of the base portion and the first flap and arranged to partially encircle the body section of the footwear when the footwear is placed upon the base portion;

a second rear strap secured to the base portion and arranged to partially encircle the heel section of the footwear when the footwear is placed upon the base portion; and a rear strap attaching means for attaching the first rear strap to the second rear strap such that the first and second rear straps secure the footwear to the base portion and prevent the footwear from sliding in a direction toward the heel section of the footwear.

2. A footwear holding apparatus as recited in claim 1 wherein the first and second flaps are shaped so as to fit snugly over the footwear when the first and second flaps are attached, and wherein the first flap overlaps the second flap such that the flap attaching means is operable to adjust the size of the footwear holding apparatus so that a wide variety of sizes of said footwear may be accommodated.

3. A footwear holding apparatus as recited in claim 1 further comprising a third strap secured to one of the base portion and the first flap and being arranged to encircle the body section of the footwear and prevent the footwear from sliding in a direction toward the toe section of the footwear.

4. A footwear holding apparatus as recited in claim 1 wherein the base portion is one of an item of luggage and a backpack, and the footwear holding apparatus is secured to the outside of said one of an item of luggage and a backpack.

5. A footwear holding apparatus for securing an item of footwear to the outside of an item of luggage, the item of footwear having an opening for a foot to be inserted, a toe section, a body section located forward of the opening between the toe section and the opening, and a heel section located rearward of the opening, the footwear holding apparatus comprising:

a center portion having a first end and a second end, said center portion secured to the outside of an item of luggage, such that when said item of footwear is secured in said footwear holding apparatus, said item of footwear is snugly attached to said item of luggage and is visible from the outside;

a first flap secured to the center portion first end and arranged to partially encircle the body section of the footwear when the footwear is placed upon the center portion;

a second flap secured to the center portion second end and arranged to partially encircle the body section of the footwear when the footwear is placed upon the center portion, wherein the first and second flaps form a continuous large flap with the center portion, the large flap arranged to completely encircle the footwear when the first flap is attached to second flap and to cover a substantial portion of the body section of the footwear;

a flap attaching means for attaching the first flap to the second flap to produce an encirclement, such that the first and second flaps secure the footwear within the encirclement substantially at the body section of the footwear, said first and second flaps producing an encirclement that narrows in a direction toward said toe section of said footwear;

a first rear strap secured to one of the center portion and the first flap and arranged to partially encircle the body section of the footwear when the footwear is placed upon the center portion;

a second rear strap secured to the center portion and arranged to partially encircle the heel section of the footwear when the footwear is placed upon the center portion; and a rear strap attaching means for attaching the first rear strap to the second rear strap such that the first and second rear straps secure the footwear to the center portion and prevent the footwear from sliding in a direction toward the heel section of the footwear.

6. A footwear holding apparatus as recited in claim 5 wherein the first and second flaps are shaped so as to fit snugly over the footwear when the first and second flaps are attached, and wherein the first flap overlaps the second flap such that the flap attaching means is operable to adjust the size of the footwear holding apparatus so that a wide variety of sizes of said footwear may be accommodated.

7. A footwear holding apparatus as recited in claim 5 further comprising a third strap secured to one of the center portion and the item of luggage and being arranged to encircle the body section of the footwear and prevent the footwear from sliding in a direction toward the toe section of the footwear.

8. A holding apparatus for securing an item of footwear, the apparatus comprising:

a flap portion having first and second ends, said flap portion formed of a heavy material, said flap portion shaped such that when said flap portion is arranged to encircle the item of footwear a curved contour of said flap portion matches with a curved contour of a top surface of the item of footwear thus providing a snug fit;

an attachment means for attaching said first and second ends of said flap portion and thus forming a continuous shape arranged to encircle the item of footwear, the continuous shape having a substantially oval front opening and a substantially oval rear opening, said heavy material of said flap portion being arranged such that said item of footwear may be easily removed from and easily inserted into said substantially oval rear opening of said continuous shape; and a rear strap means for attaching the first end of the flap portion to an intermediate part of the flap portion such that the rear strap means passes across the rear opening, said intermediate part of the flap portion located between said first and second ends of said flap portion.

9. A holding apparatus as recited in claim 8, the item of footwear having an opening for a foot to be inserted, a toe section, a body section located forward of the opening between the toe section and the opening, and a heel section located rearward of the opening, and wherein the flap portion encircles a substantial portion of the body section of the footwear.

10. A holding apparatus as recited in claim 9 further comprising a front strap secured to the flap portion and being arranged to encircle the body section of the footwear and prevent the footwear from sliding in a direction toward the toe section of the footwear.

11. A holding apparatus as recited in claim 10 wherein when the item of footwear is inserted into the rear opening the rear strap means is operable to pass around the heel portion of the item of footwear and prevent the footwear from sliding in a direction toward the heel section of the footwear.

12. A holding apparatus as recited in claim 8 wherein the first and second ends are shaped so as to fit snugly over the item of footwear when the first and second ends are attached, and wherein the first end overlaps the second end such that the attachment is operable to adjust the size of the holding apparatus so that a wide variety of sizes of said footwear may be accommodated.

13. A footwear holding apparatus for securing footwear, the footwear having an opening for a foot to be inserted, a toe section a body section located forward of the opening between the toe section and the opening, and a heel section located rearward of the opening, the footwear holding apparatus comprising:

a base portion to which the footwear can be secured;

a continuous large flap including a first flap end, a second flap end and a center portion located between the first flap end and the second flap end, the center portion being secured to the base portion, the first flap end and the second flap end arranged to partially encircle the body section of the footwear when the footwear is placed upon the center portion, the first flap end partially overlapping the second flap end and forming an opening into which said footwear may be inserted, the continues large flap being formed of a heavy material;

a flap attaching means for attaching the first flap end to the second flap end such that the first and second flap ends secure the footwear to the base portion substantially at the body section of the footwear, said heavy material of said continues large flap being arranged such that said footwear may be easily removed from and easily inserted into said opening formed by said first flap end and said second flap end overlapping;

a first rear strap secured to one of the base portion and the first flap end and arranged to partially encircle the body section of the footwear when the footwear is placed upon the base portion;

a second rear strap secured to the base portion and arranged to partially encircle the heel section of the footwear when the footwear is placed upon the base portion;

a rear strap attaching means for attaching the first rear strap to the second rear strap such that the first and second rear straps secure the footwear to the base portion and prevent the footwear from sliding in a direction toward the heel section of the footwear; and a third strap secured to one of the base portion and the continuous large flap and being arranged to encircle the body section of the footwear and prevent the footwear from sliding in a direction toward the toe section of the footwear.

14. A footwear holding apparatus as recited in claim 13 wherein said first flap end is shaped such that when said first flap end is arranged to encircle the footwear a curved contour of said first flap end matches with a curved contour of a top surface of the footwear thus providing a snug fit for said footwear.

* * * * *